US005582364A

United States Patent [19]

Trulin et al.

[11] Patent Number: 5,582,364

[45] Date of Patent: Dec. 10, 1996

[54] FLYABLE FOLDING FIN

[75] Inventors: Darryl J. Trulin, Upland; Cloy J. Bagley, Fountain Valley, both of Calif.

[73] Assignee: Hughes Missile Systems Company, Los Angeles, Calif.

[21] Appl. No.: 788,915

[22] Filed: Nov. 7, 1991

[51] Int. Cl.[6] ..... F42B 10/14

[52] U.S. Cl. ..... 244/3.29

[58] Field of Search ..... 244/3.27, 3.28, 244/3.29

[56] References Cited

U.S. PATENT DOCUMENTS

| | | | |
|---|---|---|---|
| 2,418,301 | 4/1947 | Heal | 244/75 |
| 2,565,990 | 8/1951 | Richard | 244/90 |
| 3,063,375 | 11/1962 | Hawley et al. | 102/50 |
| 3,273,500 | 9/1966 | Kongelbeck | 244/3.29 |
| 4,323,208 | 4/1982 | Ball | 244/3.28 |
| 4,334,657 | 6/1982 | Mattson | 244/3.28 |
| 4,457,479 | 7/1984 | Daude | 244/203 |
| 4,624,424 | 11/1986 | Pinson | 244/3.21 |
| 4,664,339 | 5/1987 | Crossfield | 244/3.28 |
| 4,699,333 | 10/1987 | Pinson | 244/3.21 |
| 4,714,216 | 12/1987 | Meston et al. | 244/3.29 |
| 4,884,766 | 12/1989 | Steinmetz et al. | 244/3.27 |
| 5,108,051 | 4/1992 | Montet et al. | 244/3.28 |

FOREIGN PATENT DOCUMENTS 3508103 9/1986 Germany .

*Primary Examiner*—Charles T. Jordan

*Attorney, Agent, or Firm*—Charles D. Brown; Wanda K. Denson-Low

[57] ABSTRACT

A method and apparatus for flying a folding fin from a stored folded position on a flight vehicle housing to a deployed erect position, using available aerodynamic or fluid forces to control the fin deployment. The fin is erected in several stages. First, a hinge spring bias or lifting wedge means, or combination of fin and body shape, raises the fin surface sufficiently to engage the high-speed fluid flow over the vehicle housing. Next, a motion sensor measures the fin erection angle. Finally, a feedback control system adjusts the fin control angle to increase or reduce the time rate of change of fin erection angle, as necessary. In this manner, the fin can be "flown" into its deployed position in a smooth and controlled manner whereupon it is locked into the deployed erect position on the vehicle housing. A flyable folding fin apparatus having a fixed hinge line has the additional advantage of providing vehicle stabilization immediately following launch because an independently controlled movable surface in the foldable fin assembly can be deflected without aerodynamic assistance to provide a stable aerodynamic shape immediately. Once the flight vehicle is in stable flight, this fixed hinge line fin assembly can then be erected similarly to the movable hinge line fin embodiment.

15 Claims, 4 Drawing Sheets

FLYABLE FOLDING FIN

BACKGROUND OF THE INVENTION

I. Field of the Invention

Our invention relates to foldable fin erecting apparatus in general and, more specifically, to dynamic fin control systems for controlled erection of folding fins during flight.

II. Description of the Related Art

A variety of rockets, missiles, and other similar vehicles are known in the art. Many of these vehicles are designed for launch directly from storage containers or from confined storage volumes, either underwater, on the ground or airborne. Because such vehicles require fins for stabilization and control purposes during flight, the fins must be folded or retracted to a storage position so that a minimal storage volume is required. These retracted or folded fins must be moved from the storage position to a deployed position following vehicle launch.

Early practitioners installed a variety of springs and hydraulic actuators adjacent to the fin for fin deployment. Because controlled rotation in deploying the fin is desired, conventional deployment mechanisms tend to be mechanically complex and large, producing undesired aerodynamic drag during flight. Also, such large fin erection mechanisms increase the radar cross-section of the fin and thus increase the likelihood of undesired detection of the air vehicle.

Practitioners in the art have proposed methods for minimizing the size and complexity of these fin erection mechanisms by using uncontrolled erecting devices such as a spring-loaded hinge. A fundamental problem with such uncontrolled erecting devices is the excess energy that accumulates in the fin as it accelerates from the storage position to the deployed position. This rotational energy must be absorbed by some shock absorber means or by allowing the structure of the vehicle housing to deflect or deform as the fin hits the erect position stops.

Designing such an erection system to perform with acceptable deformations is made more difficult if the vehicle is not operated into the wind with a zero angle-of-attack. As the vehicle is launched, perturbations occur that result in a non-zero angle-of-attack for the air vehicle. For a typical air vehicle having a plurality of fins, the local fluid flow field at any individual fin may be widely varying. For instance, the windward fins experience a fluid flow that tends to hold the fins down (hindering wind) while the leeward fins experience a flow force that tends to push them into deployed positions (aiding wind). The windward fins may not erect if the hindering force is sufficient to overcome the uncontrolled erecting device and the leeward fins may move into deployed position with sufficient energy to damage the air vehicle housing upon impact with the deployment stops.

Existing folding fin technology evolved from early discoveries in aircraft wingtip control surface devices. U.S. Pat. No. 2,418,301, issued to L. C. Heal, discloses an aircraft supporting surface suitable for pivotable connection to the main wing or tail plane of an airplane. Heal discloses a hinged surface driven by a hydraulically-actuated mechanism that permits the aircraft to move a portion of the wingtips into vertical position and to control this vertical portion independent of the remainder of the wings. U.S. Pat. 2,565,990, issued to G. Richard, discloses a wingtip control surface suitable for permanent attachment as a vertical component at the tips of an aircraft wing. Richard's wingtip control surfaces are also independently controlled by hydraulic means.

U.S. Pat. No. 3,063,375, issued to Wilber W. Hawley, et al., discloses a folding fin erection scheme that permits the folding fin to be rotated in two dimensions during the erection process. Hawley, et al., teach the use of rocket booster thrust forces on the order of fifteen gravities (15*g*) as an aiding force for fin erection. Their invention is not suitable for use in air vehicles not having high launch accelerations.

U.S. Pat. No. 4,323,208, issued to James Ball, discloses a folding fin assembly for a flight vehicle in which a gearing arrangement controls the relationship between fin rotations in two dimensions from storage to deployment. Ball relies on aerodynamic and inertial thrust forces to force the fin into a deployed position, and his gearing transmission operates to passively hold a fixed relationship between erection angle and fin control angle.

While Ball suggests that active motor means could be used to force the fin into position, he does not consider the problems of overcoming hindering wind forces or controlling aiding wind forces to prevent damage to air vehicle housing caused by excessive fin deployment momentum nor does he suggest a workable control scheme for active fin deployment.

U.S. Pat. No. 4,334,657, issued to Kjell Mattson, discloses a fin-stabilized projectile assembly wherein a plurality of fins are mounted on the tail section. Each fin is spring-loaded in a manner that pushes it into a deployed position immediately following launch of the projectile. Mattson teaches a completely passive erection means and does not consider the problem of housing damage because of the robust projectile housing suitable for use with his invention.

U.S. Pat. No. 4,457,479, issued to Martine Doude, discloses a winglet apparatus for aircraft wingtips having an active control system for automatically moving the winglets between an aerodynamically optimal angle-of-attack and a minimal wing bending moment angle-of-attack in response to stresses acting on the wing. Doude teaches the use of automatic moving means for optimizing the winglet effect as a function of the flight parameters and wing stress, thereby avoiding the need for structural reinforcement of the wings to accommodate the additional bending moments acting on the wings because of the presence of the winglets. However, he does not consider the application of his control schemes to the fin deployment problems known in the art.

U.S. Pat. No. 4,624,424, issued to George T. Pinson, discloses a missile yaw and drag controller actuator system having a plurality of control surfaces operated by an actuator drive. The actuator drive positions the surfaces to catch the fluid flow along the missile housing but cannot effect steering control at low missile velocities. U.S. Pat. No. 4,699,333, also issued to George T. Pinson, discloses a similar actuator-controlled panel system for missile roll control.

U.S. Pat. No. 4,714,216, issued to Spencer D. Meston, et al., discloses a fin erecting mechanism wherein the fin is rotatable about a pivot from an initial storage position to a deployed position and the erection is essentially spring-powered. Meston, et al., teach the use of a single spring for uncontrolled deployment and latching in the deployed position but do not suggest solutions to the above problems known in the art.

U.S. Pat. No. 4,884,766, issued to Harold F. Steinmetz, discloses an automatic fin deployment mechanism housed within the air flight vehicle that employs a pyrotechnic gas generator to drive the fin from storage to deployment. Steinmetz, et al., teach the Use of a clutch means that can be disengaged from the fin to permit fin rotation in a second dimension, but their invention is essentially an uncontrolled fin erection mechanism.

Other investigators such as Messerschmitt (German Patent No. DE3508-103-A) disclose fin erection mechanisms powered by the aerodynamic forces generated in the fluid flow over the vehicle housing. However, these investigators suggest no means for controlling the energy build-up in the unfolding fin to prevent housing damage on impact at the deployed position. Neither do they consider the problem of aerodynamic force variation from fin to fin on air flight vehicle bodies having multiple fins.

All these problems must be resolved for a fin design that is steerable and controllable when it is in its deployed position without interfering with proper fin control during flight and without investing in large, expensive and troublesome fin erection mechanisms. These unresolved problems and deficiencies are clearly felt in the art and are solved by our invention in the manner described below.

SUMMARY OF THE INVENTION

The primary object of our invention is to provide a means for erecting a folding fin with either a fixed or movable hinge line in a controlled manner under variable external conditions of fluid flow velocity, flow density and flow orientation. We now know that the problem of erecting a foldable fin following the launch of an air flight vehicle in air or water involves the following fundamental requirements: means for initiating the fin deployment, means for energizing the fin deployment, means for controlling the position of the fin during deployment, means for dissipating the energy built up in the fin at the deployment position and means for latching the fin in position.

For a folding fin having a fixed hinge center line, we control the erection force by one of two methods. In one case, we control the erection force by changing the effective fin camber,, which can be varied by moving a separate control flap about its hinge line. In a second embodiment, we control the erection force by rotating the entire fin assembly on its hinge.

For a folding fin having a movable hinge center line, we control the erection by rotating the control shaft on which the fin's erection hinge line is mounted. As the hinge center line is rotated, the fin orientation changes with respect to the fluid flow and thereby changes the fin erection force component arising from aerodynamic flow.

In either case, we provide at least two axes of pivot or rotation, permitting the control of aerodynamic flow forces in two angular dimensions. We also provide deployment initiation means such as spring or lever means as described in detail below. In one of the axes of rotation, we provide a power source to move the control flap or fin to a desired control angle $\theta$ about the first axis. Movement of the fin to a desired erection angle $\beta$ about the other axis of rotation is accomplished passively in our invention by virtue of the interaction between the active force applied about the first axis and the aerodynamic flow forces available following launch of the air flight vehicle.

An important feature of our invention is our use of fin motion sensors to provide the fin erection position states ($\beta$=erection angle, $\dot{\beta}$=erection angle rate, $\beta$=erection angle acceleration, etc.). These may be measured directly or may be a combination of measured and computed signals. We use these $\beta$ states in a feedback control system to appropriately vary the control angle $\theta$ about the first axis of rotation and thereby vary the erection forces arising from aerodynamic flow velocity. Our feedback control system is designed to "fly" the folded fin from its stored position to its locked deployed position in any desired manner. For example, we can control the erection movement of the fin to slow it at the deployed position thereby limiting any damage from impact of the fin with the housing. Our fin erector invention is mechanically simple and presents no more bulk or complexity than does the simplest spring-powered fin erection apparatus.

The foregoing, together with other features and advantages of our invention, will be more apparent when referring to the following specifications, claims and the accompanying drawings.

BRIEF DESCRIPTION OF THE DRAWINGS

For a more complete understanding of our invention, we now refer to the following detailed description of the embodiments illustrated in the accompanying drawings, wherein:

FIG. 5, comprising FIG. 6, comprising

DESCRIPTION OF THE PREFERRED EMBODIMENTS

Figure 1:
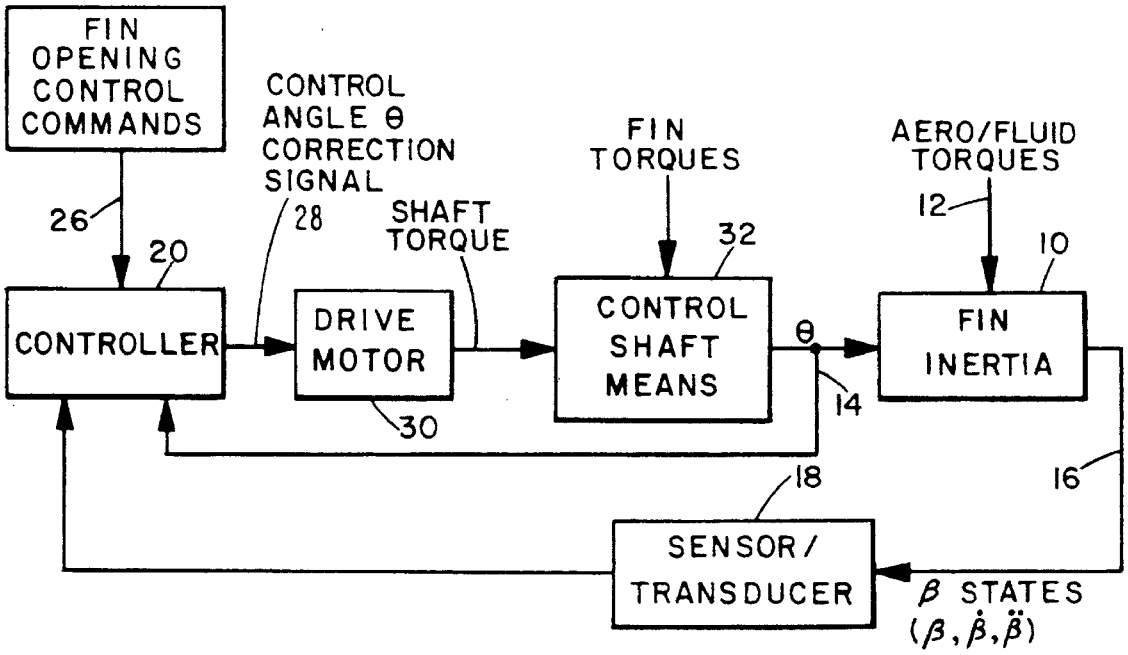
FIG. 1 illustrates a simple block diagram of the preferred embodiment of our fin erection control system.

FIG. 1 shows a simple block diagram of the essential control system portion of our invention. Our control system allows the fin designer to determine the precise characteristics of fin erection history. Our controlled erection process can be viewed as "flying the fin" to its erect deployed position. The movable fin is represented schematically as a fin inertia 10, which responds to aerodynamic forces 12 and control shaft position 14. The fin erection angle $\beta$ states 16 are defined as erection angle $\beta$, erection angle rate $\dot{\beta}$, erection angle acceleration $\beta$, and so forth.

Fin erection angle $\beta$ states 16 are sensed by a sensor transducer 18 and transmitted as electrical signals to a controller 20. Controller 20 compares measured d states 16 to requested $\beta$ state commands 26 and generates a control angle $\theta$ correction signal 28. Note that in FIG. 1 we have allowed a feedback loop for $\theta$ states as well.

An important and novel feature of our invention is the capability to generate control angle $\theta$ correction signal 28 in response to fin erection angle $\beta$ states 16. As the erecting fin accelerates, accumulating angular velocity and kinetic energy, we may now decelerate the erection process by comparing measured $\beta$ states with the desired fin opening command $\beta$ values and with the knowledge of $\theta$ we can generate a control angle $\theta$ correction signal, thereby modifying the effects of aerodynamic forces 12 and reducing fin angular momentum smoothly to zero. As seen in Figure 1, control angle θ correction output signal 28 is presented to a drive motor 30, which applies torque to a control shaft means 32. The combination of drive motor torque and the fin torques arising from aerodynamic forces 12 and inertias act to determine shaft angle 14. Changes in shaft angle 14 and the β angle determine aerodynamic forces which, in turn, are reflected in new β states 16 and, ultimately, θ correction signal 28 will fall to zero in accordance with closed-loop servomechanism control principles known in the art.

Figure 2:
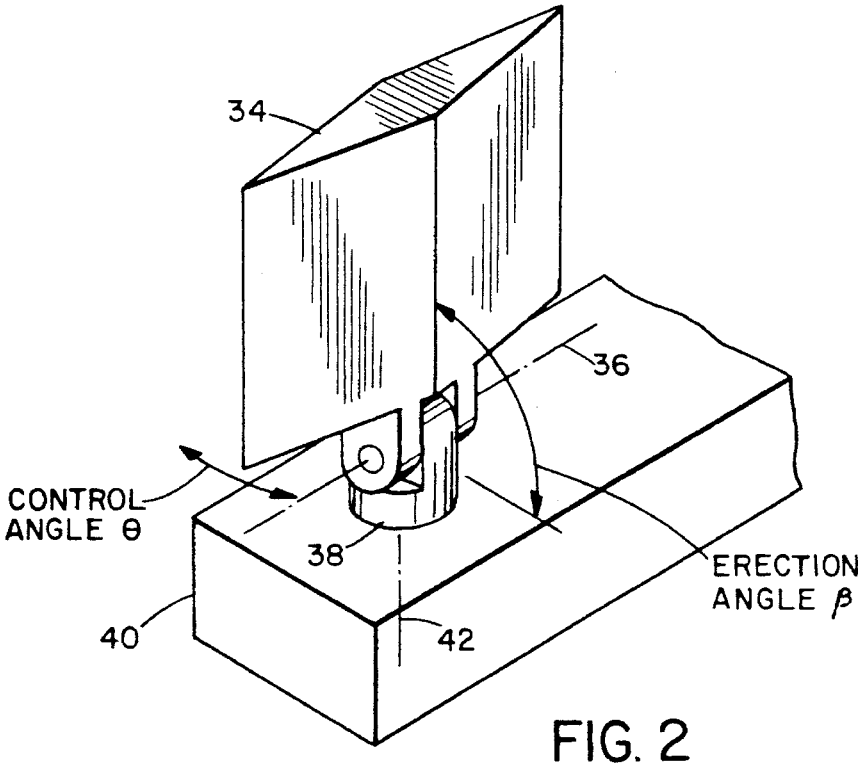
FIG. 2 shows a folding fin with a movable hinge line.

FIG. 2 shows one of several preferred embodiments of an erectable control fin suitable for application of our invention. A movable fin 34 is provided with a movable hinge line 36, which is usually a second axis of rotation that can be reoriented about a substantially orthogonal first axis of rotation. A control shaft 38 is mounted internally to the vehicle housing 40 in a manner such that control shaft 38 can turn about the first axis of rotation 42. Control shaft 38 can be turned by a drive motor (not shown) within vehicle housing 40 in response to vehicle steering signals or control angle correction signals that vary the control angle θ of movable fin 34. Movable fin 34 is shown in FIG. 2 in the fully erect deployed position at maximum erection angle β.

Figure 3:
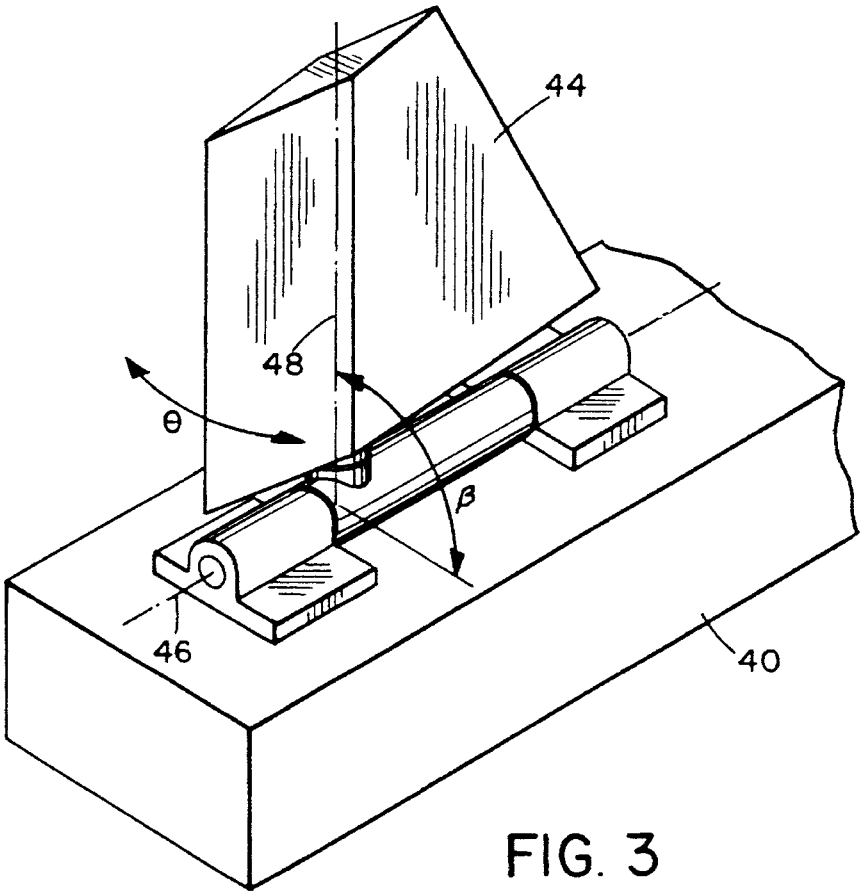
FIG. 3 shows a folding fin with a fixed hinge line wherein the entire fin is movable about a control hinge line.

FIG. 3 shows a second embodiment of a foldable fin suitable for use with our fin erection apparatus. A movable fin 44 is attached to vehicle housing 40 by means of a fixed hinge line 46, which serves as the second axis of rotation for the movement of fin 44 from stored to deployed position. A first axis of rotation 48 is provided about which movable fin 44 can rotate freely under the control of a drive motor means (not shown). Note that rotation of movable fin 44 about first axis of rotation 48 results in variation of control angle θ for the purposes of steering the air flight vehicle. Control angle θ also serves to control movable fin 44 as it erects from storage to deployment through a series of erection angle β positions about hinge line 46.

Figure 4:
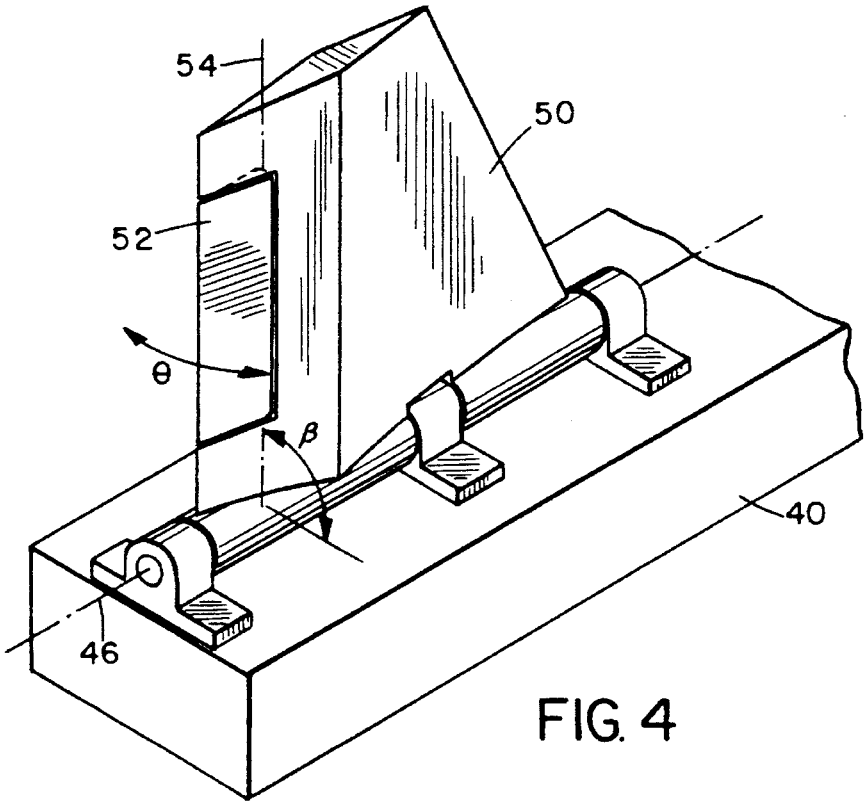
FIG. 4 shows a folding fin with a fixed hinge line wherein only a portion of the fin surface is movable about a control hinge line.

FIG. 4 illustrates an alternative embodiment of this fixed hinge line fin erection mechanism. A movable fin assembly 50 is attached to vehicle housing 40 by means of fixed hinge line 46. Movable fin assembly 50 also comprises a controlled movable surface 52 that is rotatable about a first axis of rotation 54. Controlled movable surface 52 is used to steer the air vehicle by adopting necessary control angle θ in the same manner as movable fin 44 in FIG. 3. There are no significant conceptual differences in the control system required to erect either movable fin 44 in FIG. 3 or movable fin assembly 50 in FIG. 4 from a stored to a deployed position. Accordingly, we consider only the embodiment in FIG. 4 in the following discussions.

Figure 5A:
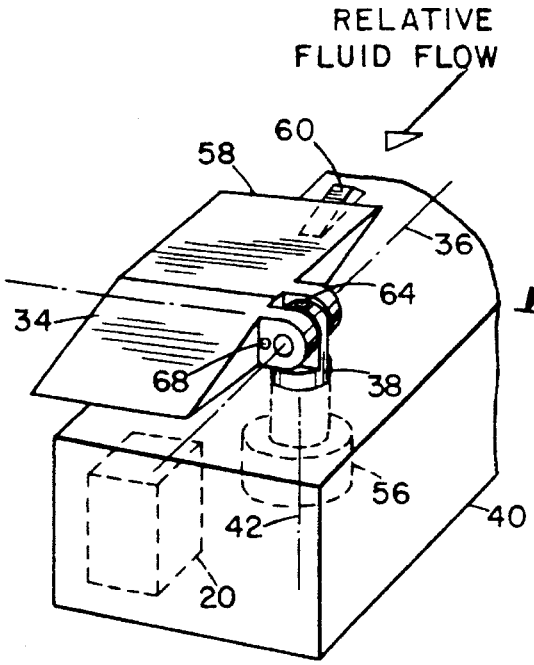
FIGS. 5A–D, shows a series of views of the folding fin from FIG. 2 as it is erected from a stored position to a deployed position.
Figure 5B:
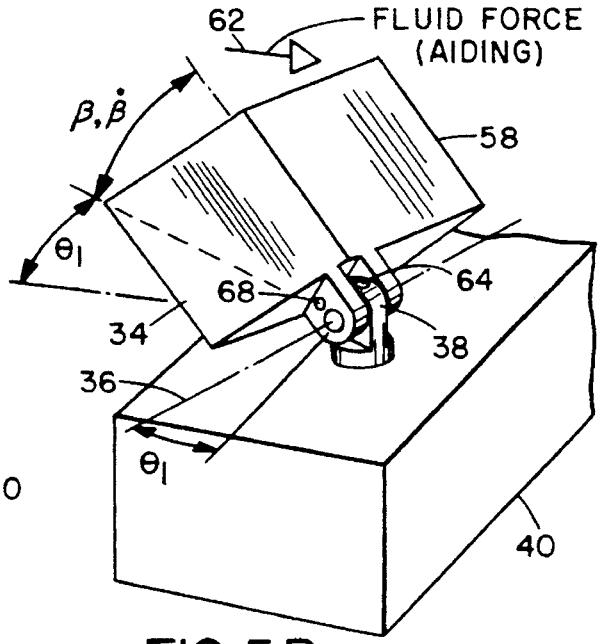

In FIG. 5, FIGS. 5A–D illustrate the erection of movable fin 34 from FIG. 2 as it is flown from a stored position of minimum erection angle β to a deployed position of maximum erection angle β. FIG. 5A shows movable fin 34 in its stored position disposed against vehicle housing 40. Control shaft 38 is shown connected to a driver motor means 56, which is adapted to turn control shaft 38 about first axis of rotation 42. FIG. 5B shows the effects of turning control shaft 38 clockwise by control angle $\theta_1$. Referring to FIG. 5A, note that such rotation forces the leading edge 58 of movable fin 34 against the lifting assist means 60, shown as a lifting wedge, thereby raising leading edge 58 away from vehicle housing 40 and into the fluid velocity stream. In the case of a cylindrical housing, the rotation of the fin against the housing may be sufficient to raise the fin enough to initiate aerodynamic lifting forces. A simple hinge spring may also be used to initiate erection but is not preferred because of the inherent lack of initial control over such a passive erection force.

As the fluid velocity stream catches leading edge 58, the resulting aerodynamic forces act to lift movable fin 34 away from vehicle housing 40 at an erection angle β about hinge line axis 36 as shown in FIG. 5B. The resulting fluid force 62 is aiding the fin erection process when control shaft 38 is disposed at control angle $\theta_1$. The angular motion sensor means 64 senses the erection angle β position of movable fin 34 and transmits this information to controller 20 shown in FIG. 5A. Controller 20 uses the erection angle β information to determine the proper output signal to drive motor means 56 in the manner discussed above in connection with FIG. 1.

Figure 5C:
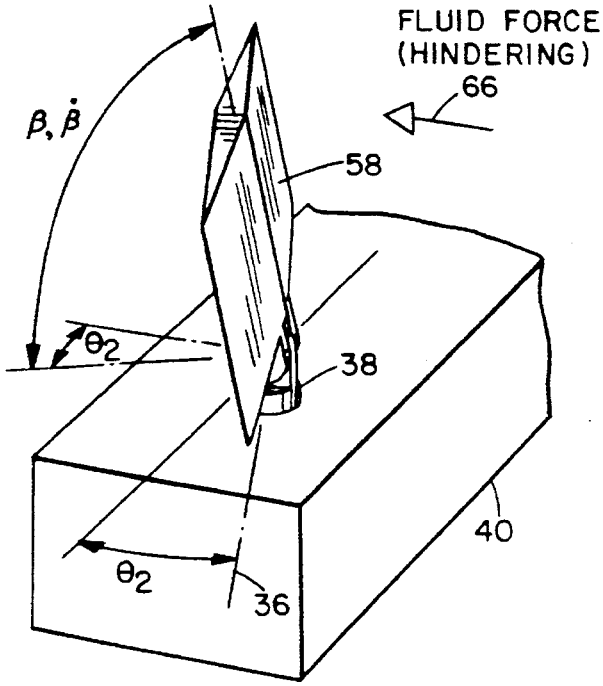
Figure 5D:
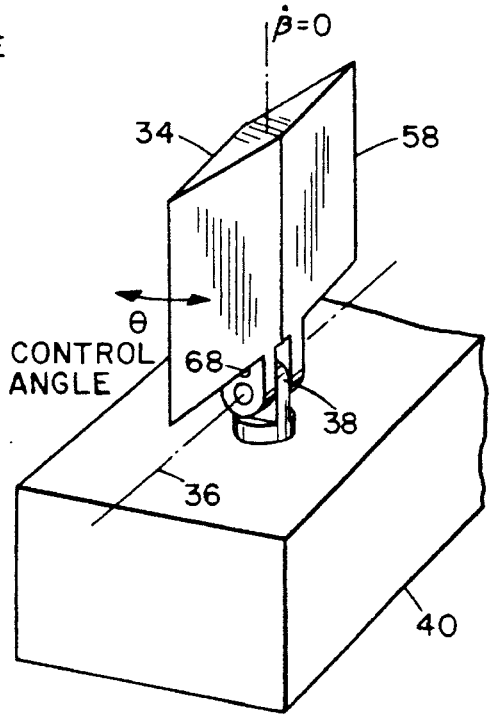

Referring now to FIG. 5C, error correction signals (not shown) from controller 20 have rotated control shaft 38 back to a new control angle $\theta_2$, where the aerodynamic forces result in a hindering fluid force 66 against movable fin 34. Hindering fluid force 66 will rapidly slow the erection momentum accumulated in movable fin 34 and, at a control angle $\theta_2$, is easily capable of reversing the erection motion and laying movable fin 34 back into its original stored position at minimum erection angle β. However, controller 20 continues to monitor the output from motion sensor means 64 and smoothly reduces the erection angle β rate to zero as the fin reaches its erect position as illustrated in FIG. 5D. Also illustrated in FIG. 5D is a deployment locking means 68, which can comprise a spring-loaded pin and detente device or any other suitable automatic locking device known in the art.

Once movable fin 34 is locked into deployment position, changes in control angle θ arising from rotation of control shaft 38 about first axis of rotation 42 will no longer force changes in erection angle Γ. Note that the process illustrated in FIG. 5 is simplified by the preferred substantial orthogonality between the two axes of rotation; second axis 36 for erection angle β and first axis 42 for control angle θ.

FIG. 6 illustrates the erection process for movable fin assembly 50 from FIG. 4. We prefer this embodiment of the folding fin having a fixed hinge line because of its capability to provide stabilization immediately following launch. The launch process is usually one in which some initial perturbations of angle-of-attack and angular velocities are imposed on the flight vehicle. Controlled movable surface 52 can be immediately deflected as shown in FIG. 6A to provide a stable "flared" shape to the vehicle following launch. Once the vehicle is stable in flight, the fin erection process can be initiated as follows.

Figure 6A:
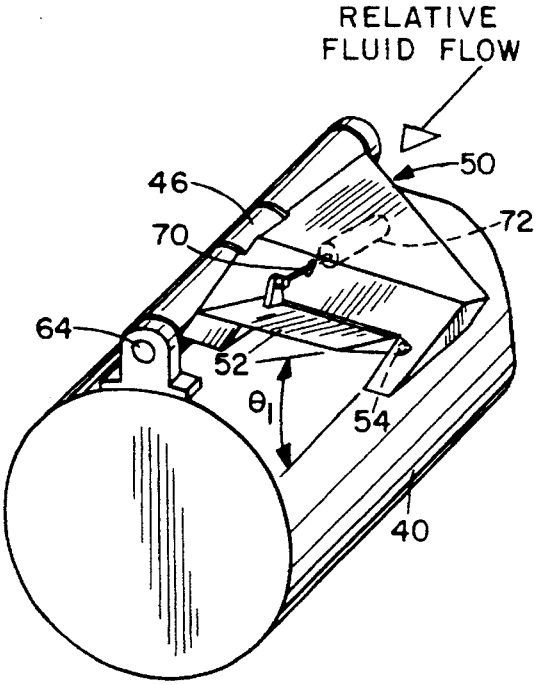
FIGS. 6A–D, shows a series of views of the folding fin from FIG. 4 as it is erected from a stored position to a deployed position.

In FIG. 6A, movable fin assembly 50 is shown in the stored position with minimum fin erection angle β and the controlled movable surface 52 is shown in a stabilizing position at control angle $\theta_1$. A power transfer device 70 is disposed to permit the movement of controlled movable surface 52 by a drive motor actuator means 72.

Figure 6B:
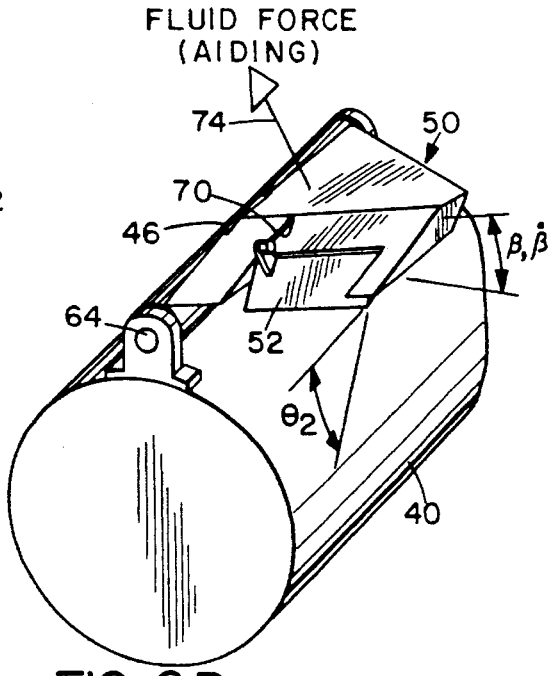
Figure 6C:
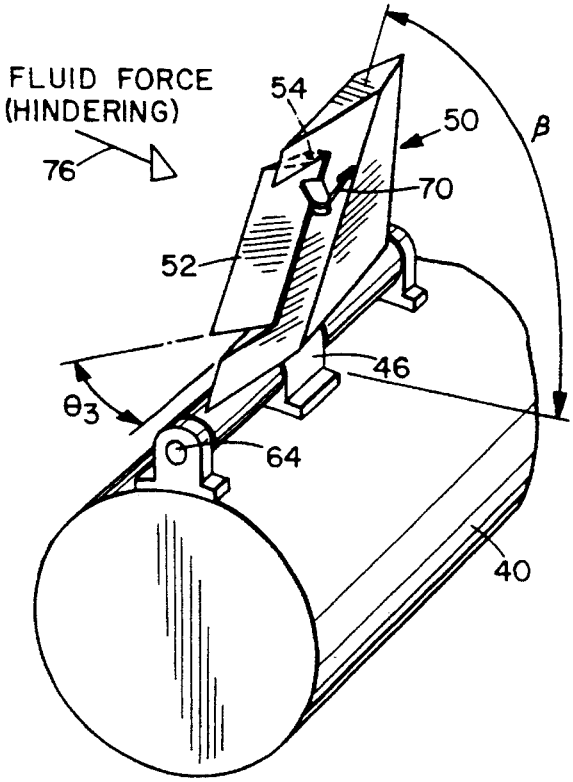
Figure 6D:
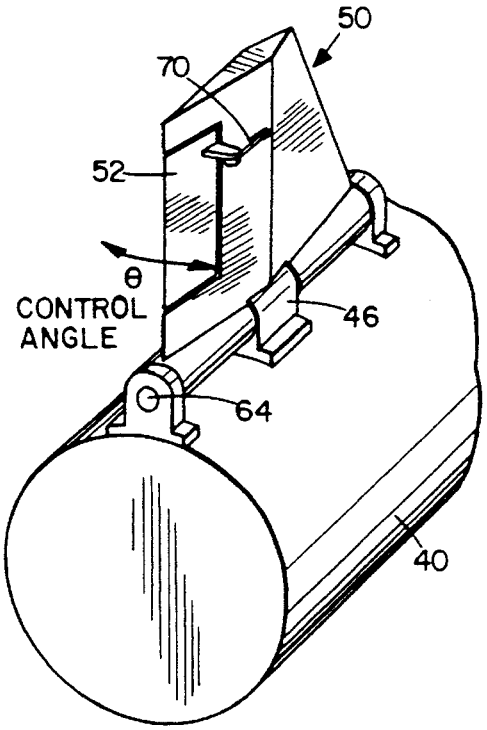

Following launch, a controller (not shown) monitors the erection position signal (not shown) from motion sensor means 64 and provides a control angle output signal to drive motor actuator means 72, thereby moving controlled movable surface 52 to the new control angle $\theta_2$ illustrated in FIG. 6B.

As controlled movable surface 52 is moved down against vehicle housing 40 to assume control angle $\theta_2$, the entire movable fin assembly 50 is forced away from vehicle housing 40 and into the air stream. At control angle $\theta_2$, the aiding fluid force 74 acts to increase erection angle β. As movable fin assembly 50 accelerates into deployment position, the controller (not shown) senses the increasing erection angle rate $\dot{\beta}$ and sends the appropriate control angle output signal to drive motor actuator means 72, thereby moving controlled movable surface 52 into a new position at control angle $\theta_3$ shown in FIG. 6C. The hindering fluid force 76 rapidly slows the erection momentum of movable fin assembly 50, bringing it to a smooth stop at the deployed position shown in FIG. 6D. Once in deployment position, a locking device (not shown) is engaged to fix movable fin assembly 50 permanently into the deployed position at maximum erection angle $\beta$. Thereafter, control angle $\theta$ of controlled movable surface 52 acts to steer the air vehicle in accordance with mission requirements as interpreted by the vehicle steering controller (not shown).

Obviously, other embodiments and modifications of our invention will occur readily to those of ordinary skill in the art in view of these teachings. Therefore, our invention is to be limited only by the following claims, which include all such obvious embodiments and modifications viewed in conjunction with the above specification and accompanying drawings.

We claim:

1. A fin erector apparatus for extending a movable fin from a stored position to a deployed position on a vehicle housing, said apparatus comprising:

control shaft means in said vehicle housing, having a first axis of rotation, for rotatably attaching said movable fin to said vehicle housing;

sensor means for creating a deployment position signal in response to the position of said movable fin;

control processor means for generating a control output signal in response to said deployment position signal;

hinge means in said movable fin, having a second axis of rotation, for pivotally attaching said movable fin to said control shaft means; and drive motor means for applying a torque to said control shaft means in response to said control output signal.

2. The fin erector apparatus described in claim 1 wherein:

said control processor means further comprises rate processor means for modifying said control output signal in response to the time rate of change of said deployment position signal.

3. The fin erector apparatus described in claim 2 wherein:

said deployment position signal is representative of the erection angle of said movable fin about said second axis of rotation.

4. The fin erector apparatus described in claim 1 further comprising:

deployment locking means for locking said movable fin in said deployed position.

5. The fin erector apparatus described in claim 1 wherein:

said first axis of rotation is disposed in substantial orthogonality to said second axis of rotation.

6. The fin erector apparatus described in claim 1 further comprising:

lifting assist means mounted on said vehicle housing for lifting an edge of said movable fin from said housing in response to rotation of said control shaft means about said first axis of rotation.

7. A fin erector apparatus for extending a movable fin assembly from a stored position to a deployed position on a vehicle housing, said apparatus comprising:

a controlled movable surface in said movable fin assembly;

first hinge means in said movable fin assembly, having a first axis of rotation, for pivotally attaching said controlled movable surface to said movable fin assembly;

second hinge means in said vehicle housing, having a second axis of rotation, for pivotally attaching said movable fin assembly to said vehicle housing;

sensor means for creating a deployment position signal in response to the position of said movable fin assembly;

control processor means for generating a control output signal in response to said deployment position signal; and drive motor means for applying a force to said controlled movable surface in response to said control output signal.

8. The fin erector apparatus described in claim 7 wherein:

said control processor means further comprises rate processor means for modifying said control output signal in response to the time rate of change of said first position signal.

9. The fin erector apparatus described in claim 8 wherein:

said deployment position signal is representative of the erection angle of said movable fin assembly about said second axis of rotation.

10. The fin erector apparatus described in claim 7 wherein:

said first axis of rotation is disposed in substantial orthogonality to said second axis of rotation.

11. The fin erector apparatus described in claim 7 further comprising:

deployment locking means for locking said moveable fin assembly in said depolyed position.

12. A method for erecting a folding fin from a storage position to a deployed position on an air flight vehicle housing having a fluid flow along said vehicle housing, said folding fin having a control angle position about a first axis of rotation and an erection angle position about a second axis of rotation, comprising the steps of:

initiating fin deployment to expose the surface of said folding fin to said fluid flow; and performing repeatedly, until said folding fin is in said deployed position, the steps of computing the time rate of change of said erection angle position, computing an erection angle velocity error by subtracting said erection angle time rate of change from a predetermined angular velocity, computing a control angle correction to said control angle position for reducing said erection angle velocity error to zero, and rotating said movable hinge line about said first axis of rotation by said control angle correction.

13. The erecting method described in claim 12 further comprising the subsequent step of:

locking said folding fin in said deployed position.

14. A method for erecting a folding fin assembly from a storage position to a deployed position on a flight vehicle housing having a fluid flow along said vehicle housing, said folding fin assembly having a controlled movable surface having a control angle position about a first axis of rotation and an erection angle position about a second axis of rotation, comprising the steps of:

initiating fin deployment to expose the surface of said folding fin assembly to said fluid flow; and performing repeatedly, until such folding fin assembly is in said deployed position, the steps of computing the time rate of change of said erection angle position, computing an erection angle velocity error by subtracting said erection angle position time rate of change from a predetermined angular velocity, computing a control angle correction to said control angle position for reducing said erection angle velocity error to zero, and rotating said controlled movable surface about said first axis of rotation by said control angle correction.

15. The erecting method described in claim 14 further comprising the subsequent step of:

locking said folding fin assembly in said deployed position.

* * * * *